US011668132B2

(12) United States Patent
Henry et al.

(10) Patent No.: US 11,668,132 B2
(45) Date of Patent: Jun. 6, 2023

(54) PROCESS FOR OBTAINING AN INSULATING GLAZING

(71) Applicant: SAINT-GOBAIN GLASS FRANCE, Courbevoie (FR)

(72) Inventors: Lucile Henry, Compiegne (FR); Camille Morin, Paris (FR); Dominique Seignard, Compiegne (FR); Erwan Baquet, Compiegne (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 17/287,847

(22) PCT Filed: Oct. 22, 2019

(86) PCT No.: PCT/EP2019/078766
§ 371 (c)(1),
(2) Date: Apr. 22, 2021

(87) PCT Pub. No.: WO2020/083939
PCT Pub. Date: Apr. 30, 2020

(65) Prior Publication Data

US 2021/0396070 A1 Dec. 23, 2021

(30) Foreign Application Priority Data

Oct. 23, 2018 (FR) ..... 1871278

(51) Int. Cl.
*E06B 3/663* (2006.01)
*E06B 3/673* (2006.01)

(52) U.S. Cl.
CPC ..... *E06B 3/66333* (2013.01); *E06B 3/6733* (2013.01); *E06B 2003/66338* (2013.01); *E06B 2003/66385* (2013.01)

(58) Field of Classification Search
CPC ..... E06B 3/66333; E06B 3/6733; E06B 2003/66338; E06B 2003/66385; G01B 11/06; G01B 3/30; G01B 5/02
See application file for complete search history.

(56) References Cited

U.S. PATENT DOCUMENTS 5,827,392 A * 10/1998 Buckley ..... B29C 70/504 264/494
9,850,160 B2 * 12/2017 Marjanovic ..... B23K 26/40
(Continued)

FOREIGN PATENT DOCUMENTS

DE 202012013218 U1 * 8/2015 ..... E06B 3/025
FR 3048861 A1 * 9/2017 ..... B32B 17/06
(Continued)

OTHER PUBLICATIONS

Eastern Gage, Feeler Gage blades & Coils Carbon Steel Metric Sizes, https://www.easterngage.com/products/feeler-gage-blades-coils-carbon-steel-metric-sizes/ (published Jul. 25, 20217 and obtained from Wayback Machine) (Year: 2017).*
(Continued)

*Primary Examiner* — Theodore V Adamos
(74) *Attorney, Agent, or Firm* — Pillsbury Winthrop Shaw Pittman LLP

(57) ABSTRACT

A process for obtaining an insulating glazing including first and second glass sheets that are held parallelly spaced apart with a transparent glass spacer adhesively bonded to the periphery of the glass sheets to make a gas-filled interlayer space, includes providing the spacer that is substantially parallelepipedal and including two rough faces opposite one another, and two smooth faces opposite one another, assembling the spacer between the glass sheets so that each rough face of the spacer is positioned close to an edge, and against an inner face of each glass sheet, the interstitial width between the rough faces of the spacer and the inner faces of
(Continued)

the glass sheets being less than 0.01 mm, depositing, at the external joint lines between the rough faces and the inner faces, a transparent adhesive, the adhesive moving by capillary action to cover the surface of the rough faces, then curing the adhesive.

21 Claims, 1 Drawing Sheet

(56) References Cited

U.S. PATENT DOCUMENTS 10,253,550 B1* 4/2019 Kim ..... C03C 27/10
10,760,326 B2* 9/2020 Baquet ..... B32B 17/06
2011/0045280 A1* 2/2011 Varma ..... B32B 17/10302 428/428
2012/0090253 A1* 4/2012 Beresford ..... E06B 3/66333 52/204.593
2014/0340730 A1* 11/2014 Bergh ..... B32B 17/10155 359/275
2015/0079313 A1* 3/2015 Vogel-Martin ..... E06B 3/66304 52/786.13
2015/0330137 A1* 11/2015 Meyer ..... B32B 17/10752 428/34
2017/0283671 A1* 10/2017 Hynes ..... C09J 5/06
2017/0362882 A1* 12/2017 Boucher ..... E06B 3/66352
2018/0172417 A1* 6/2018 Umbricht ..... G01B 3/30
2019/0100958 A1* 4/2019 Baquet ..... B32B 7/12
2019/0144325 A1* 5/2019 Bowden ..... C03B 33/0222 219/121.69
2019/0177104 A1* 6/2019 Ishida ..... C03B 17/06
2020/0408032 A1* 12/2020 Schlögl ..... E06B 3/66333

FOREIGN PATENT DOCUMENTS

WO WO 2017/157634 A1 9/2017
WO WO 2017/157636 A1 9/2017

OTHER PUBLICATIONS

International Search Report as issued in International Patent Application No. PCT/EP2019/078766, dated Nov. 11, 2019.

* cited by examiner

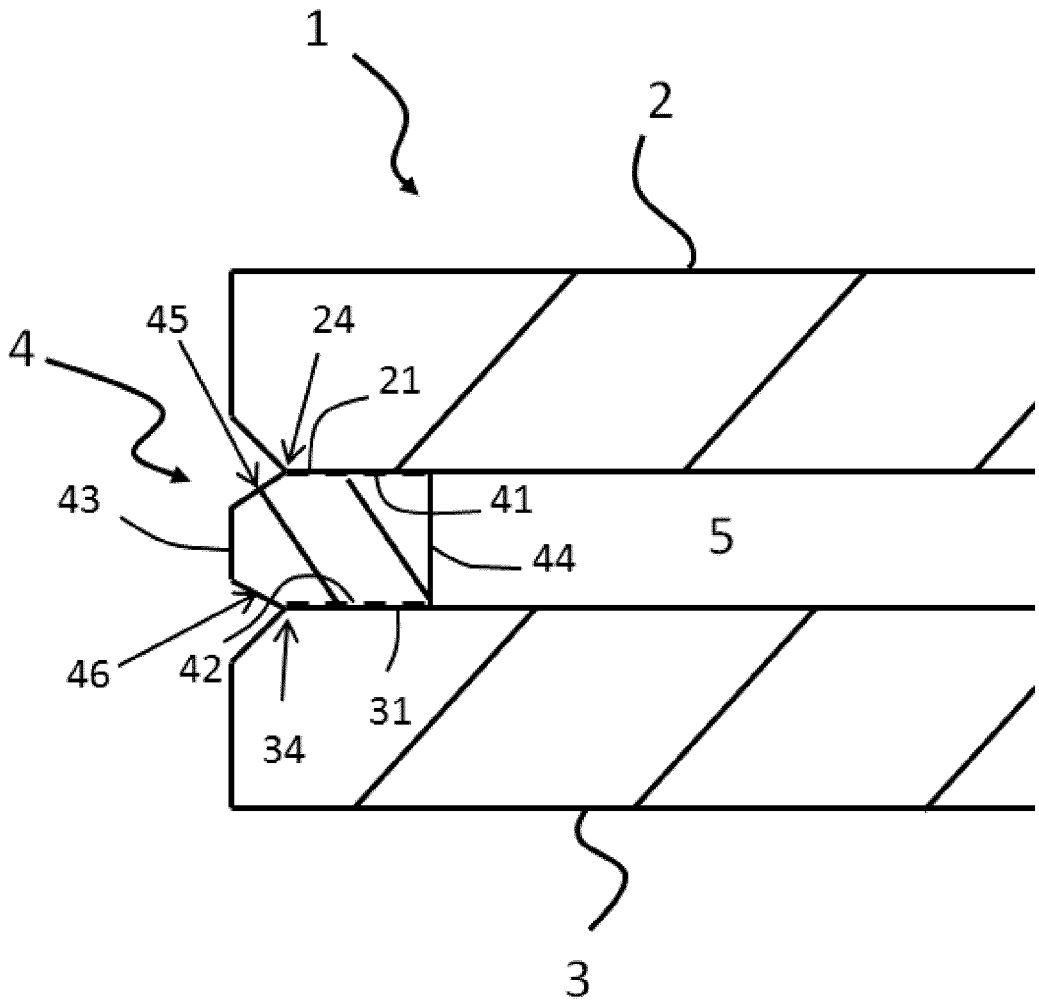
1
2
4
45
24
21
43
41
44
5
46
42
31
34
3

PROCESS FOR OBTAINING AN INSULATING GLAZING

CROSS-REFERENCE TO RELATED APPLICATIONS

This application is the U.S. National Stage of PCT/EP2019/078766, filed Oct. 22, 2019, which in turn claims priority to French patent application number 1871278 filed Oct. 23, 2018. The content of these applications are incorporated herein by reference in their entireties.

The invention relates to the field of insulating glazings intended to be incorporated into doors of climate-controlled, and in particular refrigerated, enclosures or units. These insulating glazings comprise at least two glass sheets that are held parallelly spaced apart with the aid of at least one transparent glass spacer adhesively bonded to the periphery of said glass sheets so as to make a gas-filled interlayer space.

The invention will more particularly be described with regard to a refrigerated unit application, without however being limited thereto. The glazing of the invention may be used in any architectural application, any exterior-glazing application, any interior-glazing application, any partitioning application, etc.

Among the spacers, a distinction is made between those made of synthetic material or made of organic material and those made of glass. The present invention exclusively relates to glass spacers.

A climate-controlled enclosure is more particularly intended to form a chiller unit or freezer unit in which chilled or frozen products are respectively displayed, these products possibly being items of food or drinks or any other products that need to be kept cold—pharmaceutical products or flowers for example.

Although frozen products are increasingly being sold in units provided with what are called "cold" doors, comprising transparent insulating glazings, at the present time self-service fresh and ultra-fresh items of food are essentially sold in stores by means of vertical units that are open-fronted. Provided at the front face with a curtain of refrigerated air in order to isolate the items of food from the warm ambient environment of the store and to keep the items of food at their optimal preservation temperature, these units are quite effective from this point of view and, in the absence of physical barrier, allow products to be accessed directly, facilitating the act of purchase.

However, the absence of physical barrier in these vertical chiller units leads to substantial heat exchange between the ambient environment of the store and the much colder ambient environment generated inside these units, this having the following consequences:

- this heat exchange must be compensated for by greater refrigeration in order to guarantee temperatures that are optimal for the preservation of the food in the unit, this disadvantageously increasing the power consumption of these units;
- the ambient environment of the store is considerably cooled locally (cold-aisle effect), this leading to consumers avoiding venturing into these aisles except for essential purchases, reducing impulse buying. This local cooling of the aisles in question has grown over the last few years as the strictness of hygiene regulations has led to the temperature of conservation of foodstuffs being further decreased;
- moist air from the ambient environment of the store is siphoned off by the cold-air curtain on the front face of the unit, this leading to a rapid saturation of the unit's heat exchanger (also called an evaporator) which ices up, which then significantly decreases the efficiency of the heat exchange. It is therefore necessary to frequently de-ice the evaporator, typically two times per day, this leading to an increased power consumption and generating costs.

Confronted with these drawbacks, unit manufacturers have attempted to provide solutions, in particular involving optimizing the air curtains and heating the aisles with radiant heaters or hot-air blowers. The progress nevertheless remains limited with respect to customer comfort, and is to the detriment of power consumption. Specifically, the heat produced by these heating systems, which guzzle power, partly heats the units, and thereby leads in the end to even more power being consumed to refrigerate these units.

Providing these open-fronted units with conventional cold doors allows these drawbacks to be effectively addressed. However, these solutions, which are tried and tested in freezer units for frozen products, have been slow to be adopted in chiller units. These doors have the disadvantage of placing a physical barrier between the consumer and the self-service product, possibly having potential negative consequences on sales.

Furthermore, these doors are manufactured to a design similar to that of the windows used in buildings: a frame made of profiles, generally made of anodized aluminum for reasons of esthetics, resistance to aging and ease of manufacture, frames the entire periphery of a double or triple glazing. The frame is generally adhesively bonded directly to the periphery and to the external faces of the glazing; it participates in the rigidity of the structure and allows the interlayer means (spacers) placed on the periphery of the glazing and separating the glass sheets to be masked from sight. However, such a structural frame significantly decreases the vision area through the glazing.

It was then proposed, to improve the vision area through glazings, to manufacture insulating glazings with spacers that are transparent at least on their vertical sides, furthermore creating a visual perception that all of the refrigerated windows placed side-by-side form a continuous transparent area.

Processes are known in particular in which the transparent spacers are made of glass and result from waterjet cutting making it possible to guarantee a surface for association with the glass sheets that is perfectly parallel. The rough faces, due to the jet, are arranged at the edge face of the glazing so as to bring the glass sheets together via the perfectly smooth faces of the spacers. This process however necessitates cutting the spacers from glass sheets having exactly the thickness corresponding to the distance between the glass sheets in the insulating glazing. The waterjet cutting process furthermore only makes it possible to produce spacers having a thickness (the dimension extending in a plane parallel to the general surfaces of the glass sheets in the mounted position of the spacer) of at least 12 mm. The desired vision area and the desired transparency effect are therefore reduced.

Application WO 2017/157636 proposes insulating glazings in which the transparent glass spacers result from a step of cutting, for example by scoring-breakage, creating "crude" or rough faces, and are assembled with the glass sheets by positioning these rough faces against the faces of the glass sheets, then by making an adhesive flow starting from the external junction between these two faces. The process for manufacturing the insulating glazings is thus facilitated, in particular by the possibility of cutting the spacers from glass sheets of standard thicknesses. This process also makes it possible to gain further in terms of vision area and transparency, since on the one hand the spacers may have a reduced thickness and on the other hand the faces of the spacer forming the edge face of the glazing are perfectly smooth and therefore provide an effect of perfect transparency when the glazing is observed in perspective. The adhesive used may in particular be UV cross-linkable.

It has however been observed that the glazings thus obtained could be sensitive to aging, in particular in a wet environment. More particularly, cracks may appear over time in the adhesive. Besides a degradation of the esthetic appearance of the glazings, these cracks may lead to a reduction in the sealing of the door.

The invention therefore aims to avoid this drawback by proposing an improved process that makes it possible to obtain insulating glazings having a better resistance to aging, and consequently a better long-term sealing retention.

For this purpose, one subject of the invention is a process for obtaining an insulating glazing comprising first and second glass sheets that are held parallelly spaced apart with the aid of at least one transparent glass spacer adhesively bonded to the periphery of said glass sheets so as to make a gas-filled interlayer space, said process comprising the following steps:

- a step of providing said spacer, said spacer being substantially parallelepipedal and comprising at least two rough faces opposite one another, and two smooth faces opposite one another, then
- a step of assembling said at least one spacer between the glass sheets, so that each rough face of said spacer is positioned close to an edge, and against a face, referred to as an inner face, of each of said glass sheets, the interstitial width between the rough faces of the spacer and the inner faces of the glass sheets being less than 0.01 mm, then
- a step of depositing, at the external joint lines between the rough faces of the spacer and the inner faces of the glass sheets, a transparent adhesive, said adhesive moving by capillary action so as to cover the surface of said rough faces of the spacer, then
- at least one step of curing said adhesive.

Another subject of the invention is an insulating glazing capable of being obtained by this process, said glazing comprising first and second glass sheets that are held parallelly spaced apart with the aid of at least one transparent glass spacer adhesively bonded to the periphery of said glass sheets so as to make a gas-filled interlayer space.

The particular choice, according to the invention, of the width of the interstice between the rough faces of the spacer and the inner faces of the glass sheets during the assembling step, makes it possible to prevent the appearance of the cracks described above.

In the process known from application WO2017/157636, the width of the interstice varies locally since the flatness of the spacer is never perfect, and even the periodic use of clamps does not make it possible to ensure such a small interstice over the entire length of the spacer. There are therefore zones in which the interstice is typically at least 0.1 or 0.2 mm, and may even range locally up to 1 mm. It is in these zones that the cracks are most likely to form after aging.

The process according to the invention may also comprise, prior to the step of providing the spacer, a step of cutting the spacer, in particular by scoring-breakage or laser cutting, from a glass sheet, in particular obtained by the float process. This cutting step may be carried out in the same workshop or at the same factory as the following steps of the process, or may have been carried out in another workshop or another factory, or even by another economic player. The cutting step is preferably followed by at least one polishing step in order, where necessary, to adjust the roughness of the rough faces. The polishing may be, for example, a mechanical polishing using abrasive powders.

The spacer preferably has an overall square or rectangular cross section. The glass of the spacer is preferably a monolithic glass. The spacer preferably has two chamfers on one of the smooth faces, more particularly the one intended, in the mounted position of the spacer, to form the edge face of the glazing. These chamfers make it possible to facilitate the step of deposition of the adhesive starting from the external junctions between the rough faces of the spacer and the inner faces of the glass sheets.

The glass spacer preferably has a thickness less than or equal to 14 mm or less than or equal to 12 mm, in particular a thickness between 4 and 14 mm, in particular between 6 and 12 mm, or even between 8 and 11 mm. This thickness is reduced compared to that of spacers obtained by waterjet cutting.

The glass spacer preferably has a width ranging from 10 to 16 mm, in particular from 12 to 14 mm.

The "thickness" is understood in the present text to mean the dimension extending in a plane parallel to the general surfaces of the glass sheets in the mounted position of the spacer, i.e. the dimension extending from the edge face of the glass sheets toward the interior of the glazing. The thickness therefore corresponds to the distance between the smooth faces of the spacer. This thickness also corresponds to the thickness of the glass sheet from which the spacer was cut.

As regards the "width" of the spacer, it corresponds to the distance between the rough faces of the spacer, therefore to the dimension separating the two glass sheets in the mounted position of the spacer.

The Rz roughness of the rough faces of the spacer is preferably within a range of from 1 to 10 μm, preferably from 2 to 9 μm. This roughness corresponds to the Rz roughness within the meaning of the ISO 4287:1997 standard. For the evaluation of the roughness, the cut-off wavelength $\lambda c$ is preferably 0.8 mm. Such a roughness is favorable to obtaining interstice widths as claimed.

The smooth faces of the spacer preferably correspond to faces of glass sheets obtained by the float process. They then have an extremely low roughness, the Rz roughness generally being less than 0.2 μm. In any case, the roughness of the smooth faces is less than the roughness of the rough faces.

The glass sheets are preferably made of tempered glass. The thickness of each of the glass sheets is between 2 and 5 mm, and is preferably from 3 to 4 mm in order to minimize the overall weight of the glazing and to optimize the light transmission.

The glass sheets are preferably obtained by the float process. They are preferably made of clear or extra-clear glass, still with the aim of optimizing the light transmission.

The glass sheets are held spaced apart by the spacers so as to make a gas-filled interlayer space, also referred to as a "gas space". The gas space preferably has a thickness of at least 4 mm and is adapted as a function of the desired performance of the heat transfer coefficient U, without normally being greater than 16 mm, or even 20 mm.

The gas space advantageously consists of air or preferably, in order to increase the level of insulation of the glazing, a noble gas, chosen from argon, krypton, xenon, or a mixture of these various gases, with a degree of filling of at least 85%. For a further improved U coefficient, filling with at least 92% krypton or xenon will be preferred.

In the assembling step, the or each transparent glass spacer is positioned between the two glass sheets.

The assembling step is preferably preceded by a step of applying an adhesion primer to the rough surface of the spacers and/or to the inner surface of the glass sheets which is intended to come into contact with the spacers. The step of applying the adhesion primer may itself comprise a preliminary step of depositing silica or silicates by flame pyrolysis. The flame moreover makes it possible to eliminate any residual trace of water or solvent.

The assembling step is preferably carried out horizontally, by placing the or each spacer on a first glass sheet, then by placing the second glass sheet on the or each spacer. The set of glass sheets and spacers obtained after the assembling step will be referred to as the assembly.

The or each transparent glass spacer is generally positioned along an entire edge, any abutment of spacer being detrimental to the sealing of the glazing and requiring the addition of a rather unsightly sealant.

In general, two transparent glass spacers will be positioned, close to opposite edges of the glass sheets. When the glass sheets are rectangular, these opposite edges will preferably be the long edges, which generally correspond, in the mounted position of the glazing, to the vertical parts of said glazing. In this configuration, nontransparent spacers and sealing means will also be positioned, for example metal, polymer or composite spacers and opaque sealants, along the short edges of the glass sheets, which correspond generally, in the mounted position of the glazing, to the bottom and top horizontal parts of said glazing. In order to ensure good sealing, a sealant is preferably deposited at the corners of the assembly, and therefore of the glazing, at the connection between the nontransparent spacer and the glass spacer. The term "periphery" does not therefore generally mean the whole of the periphery of the glazing, but generally at least one edge.

Clamping means, such as clips, are preferably positioned at various positions, along the edge of the glazing, so as to hold the assembly in position by exerting pressure on the glass sheets.

At the end of the assembling step, and even at the start of the adhesive deposition step, the interstitial width between the rough faces of the spacer and the inner faces of the glass sheets should be at most 0.01 mm, over the entire length of the spacer, therefore generally over the entire length of the edge of the glass sheet in the vicinity of which the spacer is placed.

The fact that the interstitial width is less than 0.01 mm or not is preferably verified, immediately after assembly and before deposition of the adhesive, using calibrated thickness blocks or gauges, typically made of steel. For this, an operator tries to insert said block in the interstice separating the rough faces of the spacer from the inner faces of the glass sheets, without forcing, over the entire thickness of the spacer, starting from the external joint line between the rough faces of the spacer and the inner faces of the glass sheets. The operation is repeated over the entire length of the edge of the glass sheets. The interstitial width is less than 0.01 mm when it is not possible to insert a block having a thickness of 0.01 mm. If there are zones of the edge of the glass sheets in which a 0.01 mm thick block can be inserted, the interstitial width is then 0.01 mm or more, and clamping means may be added or moved to these zones in order to locally reduce this interstitial width.

Surprisingly, interstices of such small width make it possible all the same to obtain sufficient adhesive bonding, with a good tensile strength. Owing to the roughness of the rough faces, the adhesive may in fact be inserted by capillary action and spread throughout the interstice, even if the latter is very small.

The adhesive is deposited at the external joint lines between the rough faces of the spacer and the inner faces of the glass sheets. An "external joint line" is understood to mean the joint line located on the outside of the glazing.

The adhesive may for example be deposited using a syringe moved along the edge. The adhesive then moves by capillary action so as to spread well in the interstice and ensure homogeneous adhesive bonding.

During the step of depositing the adhesive, the latter preferably has a viscosity between 300 and 900 mPa·s. The movement by capillary action is thus optimized.

So as to ensure a large vision area, the difference between the refractive index of the adhesive, after crosslinking, and the refractive index of the glass used for the spacers and the glass sheets, is preferably at most 0.3, in particular at most 0.2 and even at most 0.1. Thus the visual impact due to the roughness of the rough faces of the spacer is eliminated. Typically, the spacers and the glass sheets will be chosen from soda-lime-silica glass, the refractive index of which in the visible range is of the order of 1.5. The refractive index in the visible range (for example at 550 nm) of the adhesive after crosslinking is preferably between 1.4 and 1.6.

The adhesive is preferably UV crosslinkable. The UV-crosslinkable adhesive preferably comprises at least one oligomer, at least one monomer (also referred to as diluent) and at least one photoinitiator.

The oligomer preferably consists of an oligomeric chain terminated at each end by a reactive function capable of polymerizing. The oligomer preferably comprises an acrylate function at each end of an oligomeric chain chosen from polyurethane, polyester, polyether, epoxy and polysiloxane chains.

The monomer preferably has one or more reactive functions and, after polymerization, is incorporated into the polymer network. The monomer preferably comprises at least one acrylate function. The presence of monomer makes it possible to reduce the viscosity of the adhesive, the oligomer itself being too viscous.

The photoinitiator is a chemical compound, the free photolysis of which releases species that are reactive toward the functional group of the monomer. The photoinitiator is preferably of radical type. The photoinitiator is preferably an aromatic ketone.

When the adhesive is UV crosslinkable, the curing step is carried out by exposure to ultraviolet radiation.

The exposure is preferably carried out from a single side of the assembly, in order to crosslink, in a single step, the adhesive located on either side of the spacer. There is then a source of radiation on a single side of the assembly, preferably beneath the assembly.

Alternatively, the exposure may be carried out on each of the sides of the assembly. There are then two sources of radiation on either side of the assembly. In this case, the exposure may optionally be carried out simultaneously.

The or each source of radiation preferably extends over the entire length of the spacer to be adhesively bonded.

Preferably, when the assembly comprises two transparent glass spacers in the vicinity of opposite edges of the glass sheets, the exposure step is carried out using two sources of radiation, each being positioned on one and the same side of the assembly facing a single one of the spacers. It is thus possible, in a single step, to carry out the curing of the adhesive for the whole of the assembly.

It has been observed that the crosslinking conditions, in particular the type of lamp used and the power of the lamp, also had an impact on the appearance of cracks during aging. The amount of energy received, which depends on the wavelength, on the power of the lamp, on the distance between the lamp and the assembly and on the exposure time, is in particular an important parameter, in that it influences the rate of crosslinking of the adhesive, and therefore the quality of the crosslinking. The rate of crosslinking increases in particular with the amount of energy received over a given period of time. When the rate of crosslinking is too low, parasitic reactions, for example with the surroundings of the adhesive, such as water, oxygen, volatile species, compete with the adhesive crosslinking reaction, which is detrimental to the proper curing of the adhesive. Too high a rate of crosslinking leads to the appearance of stresses in the adhesive or even to start of degradation. The resistance to aging of the adhesive depends on the way in which the dose of ultraviolet radiation was delivered. For one and the same dose, the choice of the exposure time and of the intensity emitted proves to have a significant influence.

The ultraviolet radiation may be of UV-A type (wavelengths from 315 to 400 nm) and/or UV-B type (wavelengths from 280 to 315 nm).

The ultraviolet radiation is derived from at least one source of radiation. The ultraviolet radiation is preferably derived from light-emitting diodes (UV LEDs). Preferably, the emission spectrum is such that at least 95% of the power is emitted at wavelengths between 360 and 390 nm. The use of this type of device makes it possible to reduce the cracking of the adhesive relative to UV discharge lamps, which have a much broader and less intense emission spectrum, requiring longer exposure times.

It has been able to be demonstrated that the intensity emitted by the radiation source, the exposure time and the distance between the assembly and the radiation source had an influence on the appearance of cracks after aging.

The intensity of the ultraviolet radiation (emitted by the source) is preferably within a range of from 10 to 200 $mW/cm^2$, in particular from 20 to 150 $mW/cm^2$, or even from 40 to 100 $mW/cm^2$. The duration of exposure to the ultraviolet radiation is preferably within a range of from 1 to 1000 seconds, in particular from 10 to 500 seconds, or even from 100 to 300 seconds. The distance between the source of radiation and the assembly is preferably within a range of from 0.5 to 5 cm, in particular from 0.6 to 3 cm, from 0.7 to 2 cm.

The glazing may advantageously be provided, on at least one of the glass sheets, with one or more low-emissivity coatings and/or with an antifog or anti-frost layer, thus avoiding conventional heating means, this helping to save energy.

The glazing comprises two glass sheets. It may in particular comprise three thereof, the glazing then being a triple glazing. In this case, the edge face of the glazing comprises two spacers, arranged between the three glass sheets.

Another subject of the invention is a climate-controlled unit, of the refrigerated, in particular chiller, unit type, comprising at least one insulating glazing according to the invention, the glazing being in particular integrated into a door.

The unit may comprise a plurality of glazings that are placed vertically side-by-side with one another, the transparent spacer(s) generally being positioned vertically in the mounted position of the glazing(s).

The unit forms for example a refrigerated chiller unit intended to be installed in a store aisle. It is thus possible to form a unit with a whole row of doors that are laterally abutted together vertically along their edge faces.

In the case of a chiller unit/display case, since sealing is less critical than for a freezer unit, the door obtained according to the invention comprising the insulating glazing of the invention has no need to comprise vertical jambs forming a frame and provided with thick seals at the junction of two abutted doors/glazings. The glazing obtained according to the invention thus allows, because of the transparency of its vertical edges, a continuous transparent area to be achieved when the glazings are placed side-by-side via their edge faces.

Each insulating glazing comprises at least two glass sheets that are held parallelly spaced apart by spacers which are, preferably, transparent at the opposite vertical portions, in the mounted position of the glazing.

The front of the glazings and therefore of the unit is thus devoid of any structural frame and has a smooth glass-wall-like appearance. In this way vision area is increased.

The transparent spacer or spacers are preferably positioned vertically in the mounted position of the glazing(s). They are therefore generally positioned along the long edges of the rectangular glass sheets.

Transparent spacers may also be positioned horizontally in the mounted position of the glazing(s). It is however preferred to use nontransparent spacers and sealing means, in particular those typically used for the manufacture of insulating glazings, and that are therefore less expensive. The horizontal portions, at the top and bottom of the insulating glazing, are in fact located in zones where they do not hamper the visibility of the products displayed. These may in particular be metal spacers, for example made of aluminum, or polymer or composite spacers, and nontransparent sealants. A strip of enamel, for example black enamel, may be deposited, in particular by screenprinting, on at least one of the glass sheets opposite the nontransparent spacers and sealing means in order to conceal them.

Preferably, the glazing therefore comprises two transparent glass spacers adhesively bonded over the entire length of the long edges of the glass sheets, and two nontransparent spacers, for example metal, polymer or composite spacers, adhesively bonded over the entire length of the short edges of the glass sheets. In order to prevent the formation of thermal bridges and therefore to improve the thermal insulation properties of the glazing, the nontransparent spacers are preferably polymer or composite (reinforced polymer) spacers. They may for example be spacers made of styrene/acrylonitrile copolymer reinforced by glass fibers.

The glazing may also comprise, on the edge face of the long edges, a transparent profile, for example a polymer profile, in particular made of polycarbonate. This profile may be adhesively bonded to the smooth faces of the spacers located on the outside of the glazing and also to the edges of the glass sheets.

The glazing obtained according to the invention preferably has at least one of the following performances, after aging:

- a moisture penetration index measured under the conditions of the EN 1279-6 standard of at most 5%,
- a moisture penetration index measured under the conditions of the EN 1279-2 standard of at most 15%, a gas leakage rate measured under the conditions of the EN 1279-3 standard of at most 1.0% per year, in particular of at most 0.5% per year.

The following examples and FIGURE illustrate the invention in a nonlimiting manner.

FIG. 1 illustrates a partial cross-sectional view of an assembly of glass sheets and of intended transparent spacer, at the end of the assembling step.

Apart from the adhesive, the various constituents of the final glazing are represented in this FIGURE, which may therefore also represent a partial cross section of a glazing obtained according to the invention.

The glazing 1 is obtained by assembling first and second glass sheets 2 and 3, held parallelly spaced apart with the aid of a transparent glass spacer 4 so as to make an interlayer space 5, which will be filled with gas.

The spacer 4 is substantially parallelepipedal, with an overall rectangular cross section, if the presence of the chamfers 45 and 46 is disregarded. The spacer 4 comprises two rough faces 41 and 42 that are opposite one another and also two smooth faces 43 and 44 that are also opposite one another.

The spacer 4 was obtained by cutting from a sheet of float glass, the rough faces 41 and 42 corresponding to the cutting faces (optionally after a subsequent polishing) and the smooth faces 43 and 44 to the original faces of the glass sheet.

The assembling is carried out so that each rough face, respectively 41 and 42, is placed against an inner face, respectively 21 and 31, of the glass sheets 2 and 3, close to an edge. The smooth face 43 is therefore on the outer edge face of the glazing, and the smooth face 44 is turned toward the interlayer space.

During the assembling step, clips (not represented), are preferably positioned in certain zones of the edge of the assembly in order to exert pressure on the glass sheets. The assembly is preferably formed horizontally, as represented in the FIGURE. The interstitial width is thus influenced by the Rz roughness of the rough faces and by the vertical pressure due to gravity and to the clamping exerted by the clips.

In FIG. 1, the glass sheets 2 and 3 are also chamfered.

The assembly forms external joint lines 24 and 34 between the rough faces 41 and 44 and the inner faces 21 and 31 of the glass sheets. It is at these joint lines that the adhesive is deposited, for example by means of a syringe. The presence of chamfers makes it possible to facilitate this deposition step.

An assembly such as the one represented in FIG. 1 was formed from square glass sheets with sides of 10 cm and 10 cm long transparent glass spacers.

The spacers had a rectangular cross section (thickness of 10 mm and width of 13 mm) with a chamfer.

Before assembly, the rough faces of the spacers and the zone of the inner faces of the glass sheets intended to come into contact with the spacers were coated with an adhesion primer. The primer was deposited in two steps, firstly a deposition of silica by pyrolysis by means of a torch, then a deposition of a Pyrosil® primer sold by Bohle.

Clips were positioned in order to hold the assembly in place during the steps of depositing and curing the adhesive.

For the comparative examples, the interstitial width was imposed by the interposition of calibrated thickness gauges positioned at the ends of the assembly. For the examples according to the invention, no thickness gauge was positioned in the assembly, but verification using a 0.01 mm thick calibrated gauge made it possible to confirm that the interstitial width was less than 0.01 mm. Over the length of the spacer, it was indeed impossible, without forcing, to insert the gauge into the entire thickness of the spacer.

Two types of spacers were used. Spacer 1 has an Rz roughness of 5 to 6 μm, spacer 2 an Rz roughness of around 4 μm.

The adhesive (Verifix LV 740 sold by Bohle) was then deposited using a syringe at the external joint lines between the rough faces of the spacer and the inner faces of the glass sheets.

The assembly was then subjected, in the adhesive bonding zone, to exposure to ultraviolet radiation using two types of radiation sources:

a neon discharge lamp, having an emission spectrum that has a broad band ranging from 320 to 400 nm and centered on the wavelength of 360 nm, or an LED lamp having a narrow emission spectrum between 360 and 390 nm.

The lamps were located 1 cm from the assembly.

The glazings obtained were subjected to accelerated aging in a wet environment, at a temperature of 58° C. for a relative humidity of greater than 95%.

The table below presents, for each of the tests, the type of spacer (1 or 2), the interstitial width (noted i and expressed in mm), the nature of the source, the intensity of the source (noted I, in mW/cm$^2$), the exposure duration (noted d and expressed in seconds), and also the results of the aging test.

These results consist of an initiation time (noted t and expressed in hours) and a qualitative score (noted F, unitless). The score F is given after visual examination of the adhesive bonding zone. A score of 5 or less indicates an absence of cracking or very minor cracking. The higher the score, the more the adhesive bonding zone has large cracks. The initiation time corresponds to the aging time starting from which the samples obtain a score of 5.

TABLE 1

| | Spc. | i (mm) | Source | I (mW/cm$^2$) | d (s) | t (h) | F |
|---|---|---|---|---|---|---|---|
| C1 | 1 | 0.03 | Neon | 14 | 300 | 74 | 7 |
| C2 | 1 | 0.09 | Neon | 14 | 300 | 40 | 12 |
| C3 | 1 | 0.15 | Neon | 14 | 300 | 48 | 13 |
| C4 | 1 | 0.18 | Neon | 14 | 300 | 48 | 10 |
| C5 | 1 | 0.18 | LED | 75 | 180 | 72 | 12 |
| 1 | 1 | <0.01 | Neon | 14 | 300 | >408 | 1 |
| 2 | 1 | <0.01 | LED | 75 | 180 | 408 | 4 |
| 3 | 2 | <0.01 | LED | 75 | 180 | >408 | 0 |

The comparison between the examples according to the invention 1 to 3 and the comparative examples C1 to C5 shows that the choice of an interstitial width of less than 0.01 mm makes it possible to prevent, to a large extent, the appearance of cracks after wet aging.

Other aging tests were also carried out on glazings obtained according to the invention or not obtained according to the invention.

Tests of moisture penetration after a short aging cycle were carried out under the conditions of the EN 1279-standard, and in the case of an implementation of the invention in accordance with that of example 3, the moisture penetration index I was less than 5%. On the other hand, in an implementation in which the interstitial width was not less than 0.01 mm, the index I was generally greater than 10%, or even 20%.

Tests of moisture penetration after a long aging cycle (EN 1279-2 standard) were also performed. In the case of manufacture in accordance with the invention (example 3), the moisture penetration index was at most 15%.

Finally, tests for measuring the gas leakage after aging were carried out in accordance with the EN 1279-3 standard. In the case of manufacture in accordance with the invention (example 3), the gas leakage rate $L_i$ was at most 0.4% per year.

The invention claimed is:

1. A process for obtaining an insulating glazing comprising first and second glass sheets that are held parallelly spaced apart with the aid of at least one transparent glass spacer adhesively bonded to the periphery of said glass sheets so as to make a gas-filled interlayer space, said process comprising:

providing said spacer, said spacer being substantially parallelepipedal and comprising at least two rough faces opposite one another, and two smooth faces opposite one another, then assembling said spacer between the glass sheets, so that each rough face of said spacer is positioned close to an edge, and against an inner face of each of said glass sheets, the interstitial width between the rough faces of the spacer and the inner faces of the glass sheets being less than 0.01 mm, then depositing, at external joint lines between the rough faces of the spacer and the inner faces of the glass sheets, a transparent adhesive, said adhesive moving by capillary action so as to cover the surface of said rough faces of the spacer, then curing said adhesive, wherein, at the end of said assembling, the interstitial width between the rough faces of the spacer and the inner faces of the glass sheets is at most 0.01 mm over an entire length of the spacer, and thus over an entire length of the edge of the glass sheet in a vicinity of which the spacer is placed, and wherein the Rz roughness, within the meaning of the ISO 4287:1997 standard, of the rough faces of the spacer is within a range of from 1 to 10 μm.

2. The process as claimed in claim 1, wherein the spacer has two chamfers on the smooth face intended, in the mounted position of the spacer, to form the edge face of the glazing.

3. The process as claimed in claim 1, wherein, during the depositing of the adhesive, the adhesive has a viscosity of between 300 and 900 mPa.s.

4. The process as claimed in claim 1, wherein the adhesive is UV crosslinkable and the curing is carried out by exposure to ultraviolet radiation.

5. The process as claimed in claim 4, wherein the exposure to ultraviolet radiation is carried out from a single side of the assembly.

6. The process as claimed in claim 4, wherein the ultraviolet radiation is derived from light-emitting diodes.

7. The process as claimed in claim 4, wherein the intensity of the ultraviolet radiation emitted by the source is within a range of from 10 to 200 mW/cm$^2$.

8. The process as claimed in claim 7, wherein the intensity of the ultraviolet radiation emitted by the source is within a range of from 20 to 150 mW/cm$^2$.

9. The process as claimed in claim 4, wherein a duration of exposure to the ultraviolet radiation is within a range of from 1 to 1000 seconds.

10. The process as claimed in claim 9, wherein the duration of exposure to the ultraviolet radiation is within a range of from 10 to 500 seconds.

11. The process as claimed in claim 1, wherein a difference between the refractive index of the adhesive, after crosslinking, and the refractive index of the glass used for the spacers and the glass sheets, is at most 0.3.

12. The process as claimed in claim 11, wherein the difference between the refractive index of the adhesive, after crosslinking, and the refractive index of the glass used for the spacers and the glass sheets, is at most 0.1.

13. The process as claimed in claim 1, further comprising, prior to providing the spacer, cutting the spacer starting from a glass sheet.

14. The process as claimed in claim 13, wherein the cutting is carried out by scoring-breakage or laser cutting.

15. The process as claimed in claim 1, wherein the Rz roughness, within the meaning of the ISO 4287:1997 standard, of the rough faces of the spacer is within a range of from 2 to 9 μm.

16. The process as claimed in claim 1, further comprising, after said assembling and prior to said depositing, determining, with a calibrated thickness gauge or block, whether the interstitial width is at most 0.01 mm over the entire length of the spacer.

17. The process as claimed 16, wherein the calibrated thickness gauge or block has a thickness of 0.01 mm and, when the calibrated thickness gauge or block is insertable in the interstitial width at a position along the entire length of the spacer, the method further comprises reducing the interstitial width at said position with a clamp.

18. An insulating glazing obtained by the process as claimed in claim 1, said glazing comprising said first and second glass sheets that are held parallelly spaced apart with the aid of said at least one transparent glass spacer adhesively bonded at the periphery of said glass sheets so as to make a gas-filled interlayer space.

19. The insulating glazing as claimed in claim 18, which comprises two of said transparent glass spacers adhesively bonded to the entire length of the long edges of the glass sheets, and to non-transparent spacers adhesively bonded to the entire length of the short edges of the glass sheets.

20. The insulating glazing as claimed claim 18, which has at least one of the following performances, after aging:

a moisture penetration index measured under the conditions of the EN 1279-6 standard of at most 5%, a moisture penetration index measured under the conditions of the EN 1279-2 standard of at most 15%, a gas leakage rate measured under the conditions of the EN 1279-3 standard of at most 1.0% per year.

21. A climate-controlled unit comprising at least one insulating glazing as claimed in claim 18.

* * * * *